US011059612B2

(12) United States Patent
Donohue et al.

(10) Patent No.: US 11,059,612 B2
(45) Date of Patent: Jul. 13, 2021

(54) METHODS OF PACKAGING THIN METAL FILMS TO MAINTAIN THEIR PHYSICAL CHARACTERISTICS

(71) Applicant: Materion Corporation, Mayfield Heights, OH (US)

(72) Inventors: Lee A. Donohue, Windsor, CT (US); Margaret S. Fariss, Windsor, CT (US); Christopher Massing, Windsor, CT (US); Robert R. Newton, West Simsbury, CT (US); Kevin V. Goodwin, Torrington, CT (US)

(73) Assignee: MATERION CORPORATION, Mayfield Heights, OH (US)

( * ) Notice: Subject to any disclaimer, the term of this patent is extended or adjusted under 35 U.S.C. 154(b) by 308 days.

(21) Appl. No.: 15/141,983

(22) Filed: Apr. 29, 2016

(65) Prior Publication Data

US 2016/0318639 A1 Nov. 3, 2016

Related U.S. Application Data

(60) Provisional application No. 62/154,992, filed on Apr. 3, 2015.

(51) Int. Cl.

| | |
|---|---|
| ***B65B 11/58*** | (2006.01) |
| ***B65B 63/04*** | (2006.01) |
| ***C23C 14/24*** | (2006.01) |
| ***B65D 75/00*** | (2006.01) |
| ***B65D 81/24*** | (2006.01) |
| ***B65D 75/06*** | (2006.01) |
| ***B65B 11/00*** | (2006.01) |
| ***B65D 1/00*** | (2006.01) |
| *B65B 25/14* | (2006.01) |

(52) U.S. Cl.

CPC ..... *B65B 11/58* (2013.01); *B65B 11/00* (2013.01); *B65D 1/00* (2013.01); *B65D 75/006* (2013.01); *B65D 75/06* (2013.01); *B65D 81/24* (2013.01); *B65B 25/146* (2013.01)

(58) Field of Classification Search

None

See application file for complete search history.

(56) References Cited

U.S. PATENT DOCUMENTS 2,424,553 A * 7/1947 Conti ..... B65D 85/672 206/408
3,371,776 A * 3/1968 Voissem ..... B65H 75/185 206/394
3,419,138 A * 12/1968 Halsberghe ..... B65D 19/44 206/413

(Continued)

FOREIGN PATENT DOCUMENTS

WO WO 2011/013939 A2 2/2011

*Primary Examiner* — Hemant Desai
*Assistant Examiner* — Tanzim Imam
(74) *Attorney, Agent, or Firm* — Tucker Ellis LLP

(57) ABSTRACT

The present disclosure is directed to the packaging of metal thin films deposited on polymeric substrates. The packaging method prevents deleterious change of surface energy/water contact angle as a function of time for metal thin films such as rolls, coils, sheets or strips of sputtered or vacuum deposited metal thin films. Methods and kits directed toward a unique packaging and storage scheme are also disclosed. This results in maintenance of the metal film's hydrophilicity and surface energy for extended periods of time.

14 Claims, 7 Drawing Sheets

(56) References Cited

U.S. PATENT DOCUMENTS 3,627,488 A * 12/1971 Dudley ..... C23C 10/28 138/143
4,079,835 A * 3/1978 Kendig ..... B65D 21/0234 206/303
4,570,794 A * 2/1986 Capitao, Jr. ..... B65D 85/672 206/394
4,963,045 A * 10/1990 Willcox ..... A45D 34/04 206/440
5,057,403 A * 10/1991 Kume ..... G03C 3/00 206/455
5,298,708 A * 3/1994 Babu ..... B65D 81/3446 219/728
6,315,122 B1 * 11/2001 McCord ..... B65D 19/38 206/408
7,980,424 B2 * 7/2011 Johnson ..... B65D 75/5877 222/105
2002/0033350 A1 * 3/2002 Itkonen ..... B65B 11/008 206/410
2007/0145072 A1 * 6/2007 Cook ..... B65D 77/065 222/105
2007/0202284 A1 * 8/2007 True ..... B32B 7/12 428/35.2
2007/0212267 A1 * 9/2007 Organ ..... B01J 19/0046 422/130
2007/0267309 A1 * 11/2007 Cooper ..... B65H 35/00 206/409
2008/0017750 A1 * 1/2008 Sellars ..... A47K 10/3818 242/597.7
2012/0153069 A1 * 6/2012 Allwood ..... B65H 49/32 242/607
2012/0292313 A1 * 11/2012 Erlich ..... A45C 7/0077 220/9.2
2013/0130015 A1 * 5/2013 Cosentino ..... B32B 27/205 428/315.9
2013/0209618 A1 * 8/2013 Trombetta ..... B32B 1/02 426/115
2013/0255191 A1 * 10/2013 Steinhoff ..... B65B 63/04 53/430
2013/0344345 A1 * 12/2013 Sakellarides ..... C08K 5/3475 428/458
2016/0031191 A1 * 2/2016 Paulino ..... B32B 27/32 428/220

* cited by examiner

METHODS OF PACKAGING THIN METAL FILMS TO MAINTAIN THEIR PHYSICAL CHARACTERISTICS

CROSS-REFERENCE TO RELATED APPLICATIONS

This application claims priority to U.S. Provisional Patent Application Ser. No. 62/154,992, filed Apr. 30, 2015, the entirety of which is hereby incorporated by reference.

BACKGROUND

The present disclosure relates, in various exemplary embodiments, generally to methods, devices and packaging kits for maintaining the surface energy and hydrophilic nature of thin film metal coatings for extensive periods of time. In this regard, the packaging methods, enclosure devices and kits disclosed herein prevent deleterious changes of the surface energy/water contact angle as a function of time for deposited metal thin films. This includes thin films produced by roll-to-roll sputtering manufacturers, wherein the metal thin films are deposited (i.e., sputtered, vacuum deposited, etc.) onto large rolls of flexible polymeric substrates. These rolls are then divided into much smaller segments, which can be used in medical test strips, etc., by the end customer.

In this regard, vacuum deposited palladium (Pd) coatings on polymeric substrates are commonly used in the manufacture of disposable medical blood analysis devices such as biosensors and medical test strips. Biosensors can be used in several applications, such as measuring the amount of an analyte (e.g., glucose) in a biological fluid (e.g., blood). Blood glucose monitoring is a valuable tool in the management of diabetes. Diabetes is a disease in which the body is unable to control tightly the level of blood glucose, which is the most important and primary fuel of the body. This is due to either the pancreas not producing enough insulin, or to the cells of the body not responding properly to the insulin produced. Patients with diabetes are encouraged to monitor their glucose levels to prevent hyperglycemia, as well as other long-term complications such as heart disease, stroke, kidney failure, foot ulcers, and eye damage.

A glucose biosensor is an analytical device for detecting the analyte, glucose, in the blood. Although glucose biosensors have been devised based on potentiometry, amperometry, and colorimetry, to date most commercially available biosensors are amperometric biosensors. These biosensors use a redox enzyme (e.g., glutathione peroxidases (GPX), nitric oxide synthase (eNOS, iNOS, and nNOS), peroxiredoxins, super oxide dismutases (SOD), thioredoxins (Trx), and the like), as the biological component responsible for the selective recognition of the analyte of interest (e.g., glucose).

A biosensor of this type is a relatively small strip of laminated plastic that can be exposed to a biological sample such as blood. An important feature of the biosensor is that it is disposable and only used one time. The strip acts as a substrate for a reaction chamber and two electrodes, a reference electrode and a working electrode, which are connected to the reaction chamber. The glucose biosensor contains a reagent layer that is attached to the working electrode. The reagent layer includes the selective recognition component (i.e., the redox enzyme) as well as electron mediators or other substances, which can help facilitate the reaction or help stabilize the reagent layer itself. The biological fluid sample is introduced into the reaction chamber of the glucose biosensor and the biosensor is connected to a measuring device such as a meter for analysis using the biosensor's electrodes. The analyte (glucose) in the sample undergoes a reduction/oxidation reaction at the working electrode (where the redox enzyme is located) while the measuring device applies a biasing potential signal through the electrodes of the biosensor. The redox reaction produces an output signal in response to the biasing potential signal. The output signal usually is an electronic signal, such as potential or current, which is measured and correlated with the concentration of the analyte in the biological fluid sample.

In building the biosensor, a palladium thin film is deposited onto various substrates to act as an electrode. Palladium, and alloys thereof, is known to be a highly conductive material, which is desirable for an electrode. This deposition is usually performed under vacuum conditions by several roll-to-roll sputtering manufacturers wherein the palladium thin films are deposited onto large rolls of a flexible polymeric substrate. These rolls are frequently divided into smaller (i.e. thinner, less wide) rolls before packaging and shipment to the customer.

The thin film palladium coating is usually hydrophilic in nature. However, it has been found that the thin film palladium coatings, such as those found in roll form, can suffer from a significant increase in their surface hydrophobicity and resultant loss of wettability as a function of exposure time to either ambient air or more problematically air containing elevated concentrations of hydrocarbon species. These include hydrocarbon gases released from polypropylene, paper packaging, glues, adhesives, etc. In the manufacture of rolls of palladium thin films, such as palladium thin films on flexible substrates used to produce blood glucose test strips (BGTS), these changes in hydrophobicity can lead to deleterious down-stream processing issues, such as when it is desired to apply aqueous solution based reagents or other materials such as inks or sodium-2-mercaptoethanesulfonate (MESNa). It would be desirable if substrates with palladium thin film coatings could be packaged and stored in a manner so as to prevent a decrease in surface hydrophobicity and loss of wettability.

BRIEF DESCRIPTION

The present disclosure relates to new methods of packaging, transporting and storing metal-coated products, such as rolls, coils, sheets, strips, etc., of metal thin films deposited on flexible substrates, which will inhibit deleterious changes in the physical character of the metal coatings. The unique packing processes and devices maintain the surface of the metal films, keeping them hydrophilic in nature, and maintain the surface energy of the films at as-deposited levels for extensive periods of time. This permits longer storage of the metal-coated products, such as those used as new materials to form biosensors, without having to worry that the storage time will affect the later reliability of the readings, etc. provided by the sensor.

Accordingly, the present disclosure is directed to new methods of packaging and storage to prevent increases in hydrophobicity and resulting loss of wettability of metal thin film coatings such as those on polymeric substrates. Also included herein are the assorted enclosure devices incorporating these methods.

More particularly disclosed herein in various embodiments are methods of encasing rolls, coils, sheets or strips of metal thin films coatings, in order to prevent surface fouling, aging, and increasing water contact angle (WCA) of metal coated substrates and webs as a function of time. In other embodiments, the methods are used to package, store, and protect the surfaces of metal-coated products.

Disclosed in various embodiments herein are methods of packaging a metal-coated substrate to maintain the hydrophilicity and surface energy of the metal coating, comprising: wrapping the metal-coated substrate in a polyester film.

The surface of the metal coating should be hydrophilic in nature. The metal coating may have a water contact angle of 65 degrees or less after being wrapped in the polyester film for no less than 24 hours. In more specific embodiments, the metal coating has a water contact angle of 55 degrees or less after being wrapped in the polyester film for no less than 24 hours.

The metal coating may show no degradation of surface wettability after no less than 58 weeks. The metal coating may show no surface fouling after no less than 58 weeks. The metal coating may show no loss in surface energy after no less than 58 weeks.

The metal coating may be in the form of a thin film on the substrate. In particular embodiments, the thin film is formed through vacuum deposition.

The metal coating may be directly applied to the substrate. The substrate may be a polymeric substrate.

In some embodiments, the metal coating may be palladium.

In some embodiments and methods disclosed herein, the metal-coated substrate is in the form of a roll, and the methods further comprise placing disc separators on opposite sides of the roll, where the disc separators have a metalized polyester surface.

Also disclosed are methods of packaging metal coated products, comprising: covering said products in a covering material selected from the group consisting of a polyester; a metalized polyester; an aluminum foil; or metalized polyethylene terephthalate (PET).

The surface of the metal coating should be hydrophilic in nature. The metal coating may have a water contact angle of 65 degrees or less after being wrapped in the covering material for no less than 24 hours. In more specific embodiments, the metal coating has a water contact angle of 55 degrees or less after being wrapped in the covering material for no less than 24 hours.

Also disclosed are kits for packaging metal-coated products, comprising: a polyester film; and a plurality of disc separators having a metalized polyester surface.

These and other non-limiting features of the present disclosure are discussed in more detail below.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The following is a brief description of the drawings, which are presented for the purposes of illustrating the exemplary embodiments disclosed herein and not for the purposes of limiting the same.

DETAILED DESCRIPTION

Figure 1:
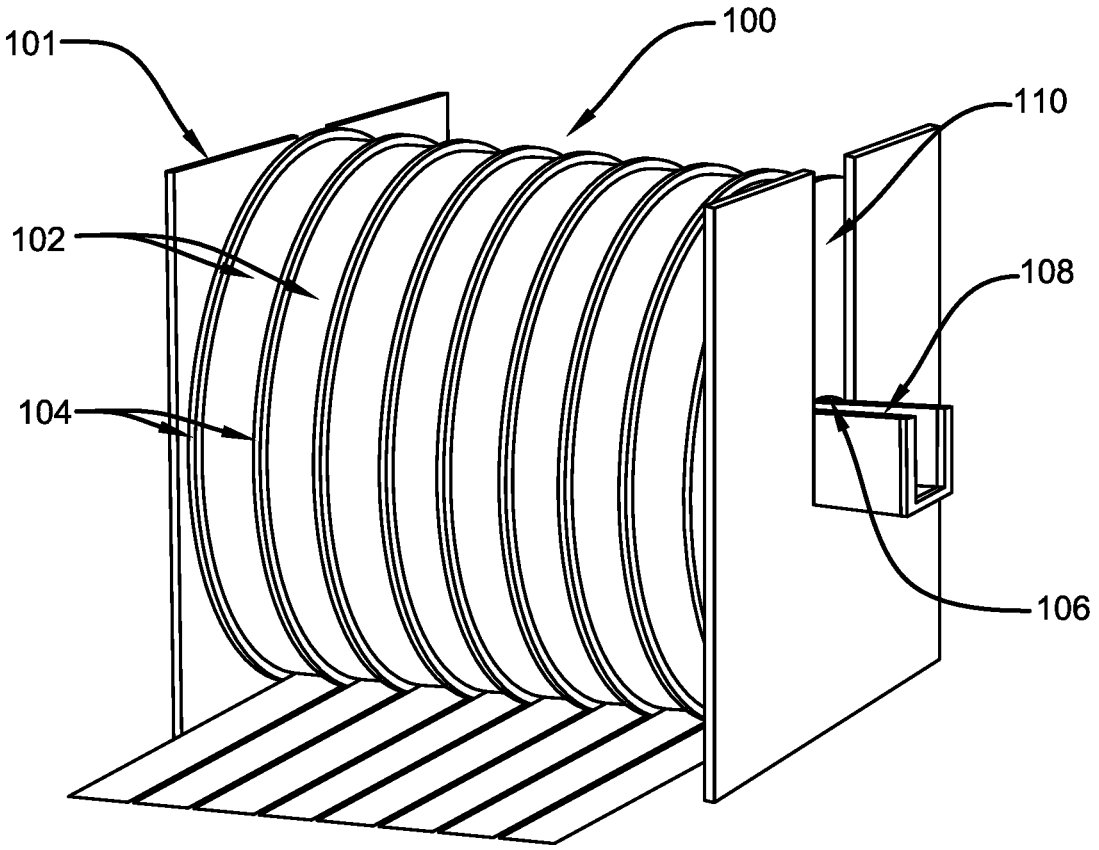
FIG. 1 is a picture showing a package of palladium-coated substrates in the form of rolls and packaged in a conventional manner.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named components/steps and permit the presence of other components/steps. However, such description should be construed as also describing compositions or processes as "consisting of" and "consisting essentially of" the enumerated components/steps, which allows the presence of only the named components/steps, along with any impurities that might result therefrom, and excludes other components/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The term "about" can be used to include any numerical value that can vary without changing the basic function of that value. When used with a range, "about" also discloses the range defined by the absolute values of the two endpoints, e.g. "about 2 to about 4" also discloses the range "from 2 to 4." The term "about" may refer to plus or minus 10% of the indicated number.

The term "water contact angle" (WCA) is the angle measured through water, where the liquid meets a solid surface, quantifying the wettability of a solid surface. The term "wettability" refers to the ability of a liquid to maintain contact with a solid surface. The lowest possible value for the WCA is zero degrees. If the water contact angle is less than 90°, the solid surface is considered to be hydrophilic, and if the WCA is 90° or more, the solid surface is considered to be hydrophobic. A smaller WCA indicates greater hydrophilicity.

The present disclosure relates to methods of packaging to prevent deleterious changes in surface energy and water contact angle as a function of time for vacuum deposited thin films on polymer substrates.

Vacuum deposited metal coatings on polymeric substrates are commonly used in the manufacture of disposable blood analysis strips and unrelated non-metal medical apparatuses. Palladium in particular was previously found to be a viable alternative as it is relatively inexpensive to its gold metal counterpart and has seen increasing prevalence as the material of choice for blood glucose test strips.

In this regard, sputtering and ion-plating are well-known methods of coating substrates with metals and other materials. Essentially, metal (such as palladium) is vaporized and partially or completely converted to an ion during or after vaporization. The metal is vaporized by bombardment with energetic ions (sputtering) or by evaporation (ion-plating), such as by a production size sputter coater. Metal ions are then drawn towards the substrate to be coated by an electric field. The substrate can be a flexible polymer, which is usually provided in the form of a roll.

The present application relates to methods of packaging, transporting and storing rolls, coils, sheets or strips of thin film metal-coated polymeric substances to maintain the surface properties thereof. It has been noted that over time, metal films exhibit a decrease in surface energy and wettability due to exposure to both ambient air or more problematically air containing elevated levels of hydrocarbon species, including gaseous sources from polypropylene, paper packaging, glues, and adhesives. It is also been noted that surface fouling increases, as does aging of the metal material. Additionally, it has been found that the interaction of metal coated substrates with adjacent packaging material cause changes in the surface energy of the coating.

FIG. 1 is a picture providing a perspective view of a bundle of finished rolls packaged in a conventional manner. Initially, the package 100 contains rolls or discs 102. The rolls or discs are formed from a polymeric substrate upon which has been coated a thin film of metal. The metal/substrate combination is then rolled up to form the rolls or discs. The package contains eight such rolls. The rolls 102 are separated by disc separators 104. As can be seen here, the disc separators have a larger diameter than the rolls 102. The rolls 102 and disc separators 104 are mounted on a core 106 which is itself mounted around a metal channel 108 (i.e. the channel passes through the core, and does not contact the rolls). The core is intended to help reduce disc distortion. Stiff square-shaped boards 101, typically made of wood, are then placed at each end of the channel 108 to support the rolls. A cutout 110 is present in each board 101, for fitting the board to the channel 108. The cutout 110 extends from the center of the board to the perimeter of the board.

In this conventional setup, the rolls 102 were wrapped around their perimeter with polyethylene stretch wrap. The disc separators 104 were then placed between each roll 102, and the rolls and disc separators were then mounted upon the core. The disc separators were made from a soft anti-static foam, usually a polyethylene or polypropylene foam. After being mounted upon the core, the rolls and disc separators were usually wrapped a second time. As a result, the rolls and the metal layers thereon were often in close contact with the polyethylene stretch wrap and foam, which can generate hydrocarbon species. In addition, it was found that the wrapping caused the outer disc separators (made of soft foam) to warp/distort during packaging. This created an avenue for air to have direct contact with the roll faces on either end of the bundle.

Figure 2A:
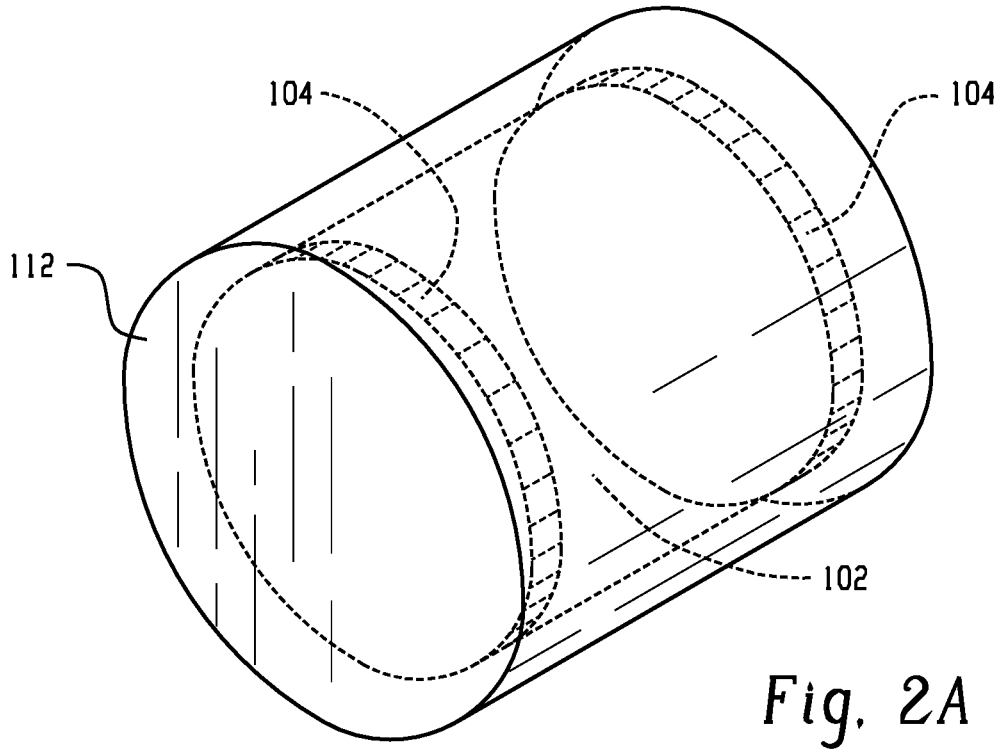
FIG. 2A is a perspective view.
Figure 2B:
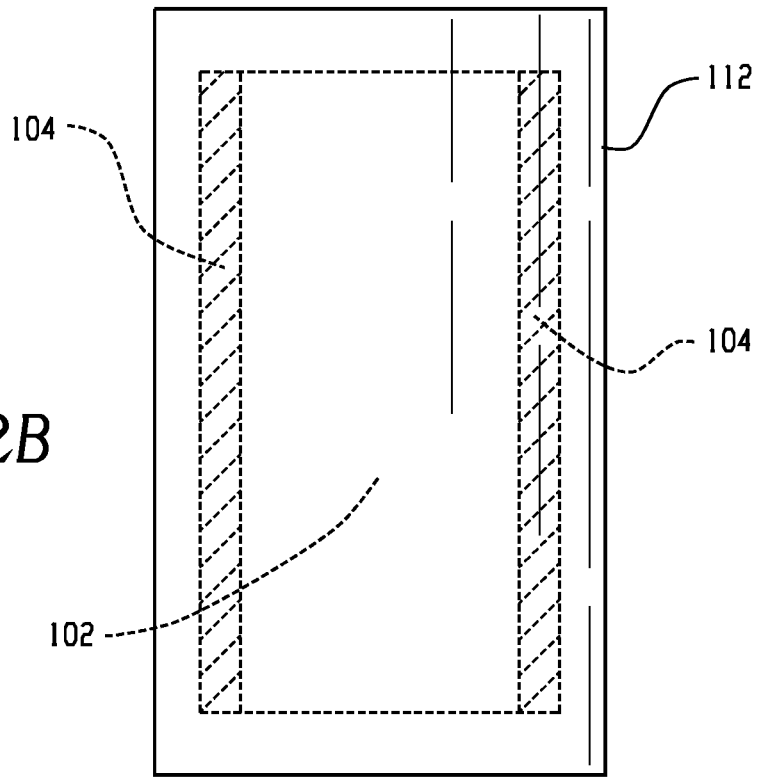
FIG. 2B is a front view, of a metal-coated substrate in the form of a roll, which is packaged according to the present disclosure.
Figure 3A:
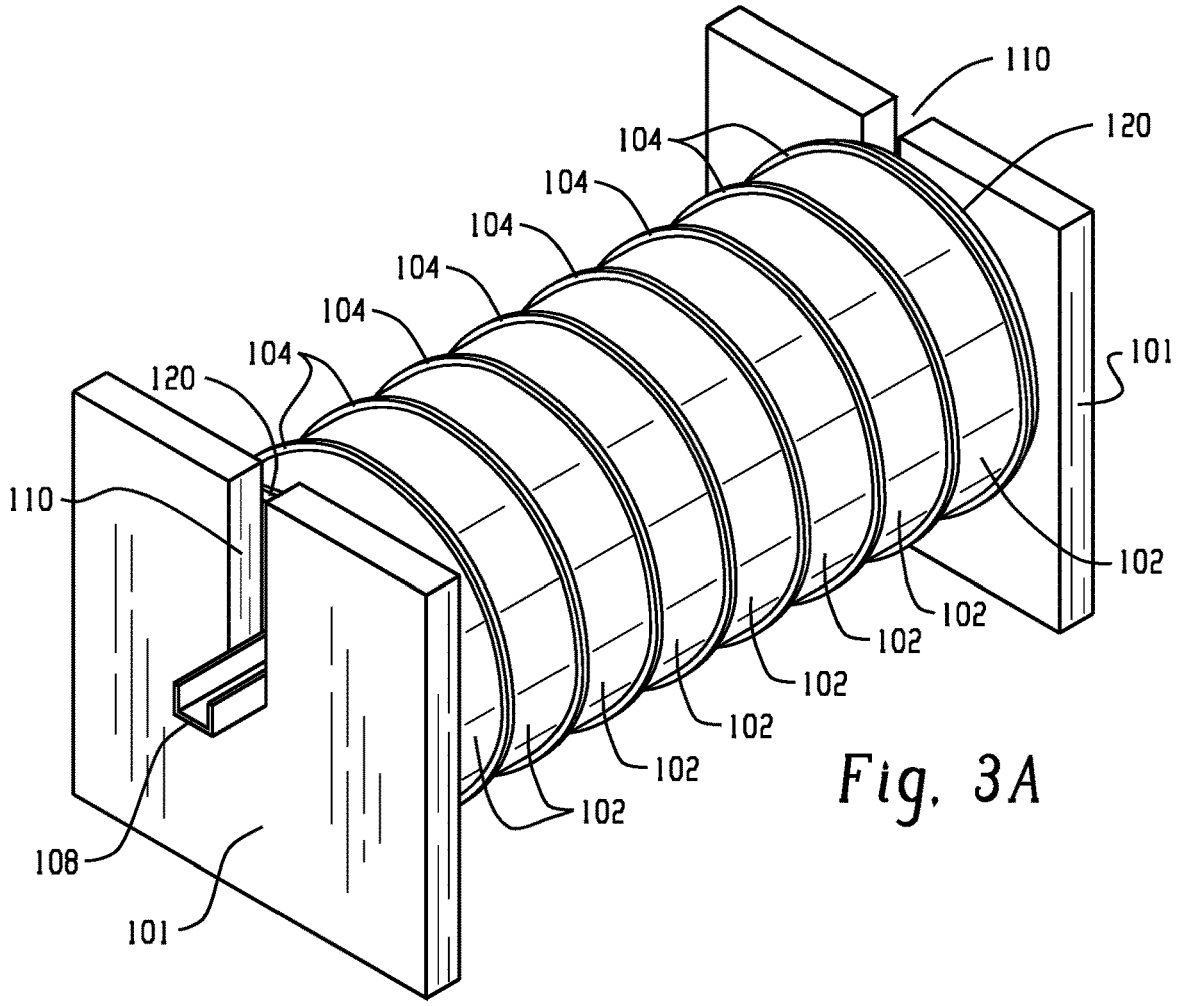
FIG. 3A is a perspective view.
Figure 3B:
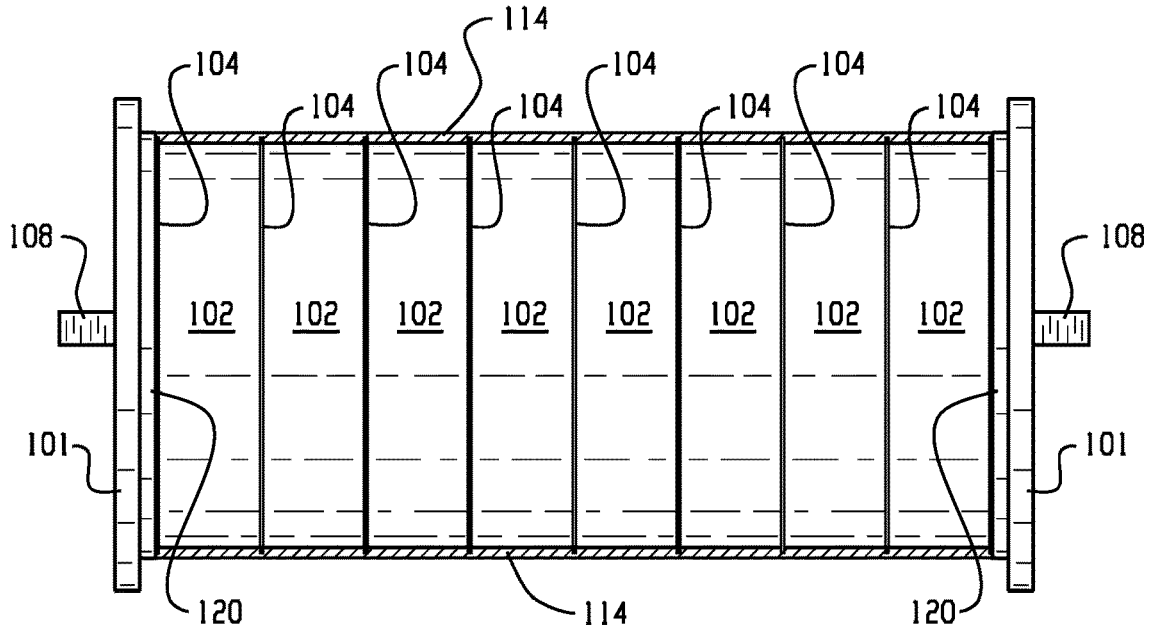
FIG. 3B is a front view, of metal-coated substrates in the form of rolls, which are packaged together in a bundle according to the present disclosure.

FIG. 2A is an exaggerated perspective view of a single wrapped roll, and FIG. 2B is an exaggerated front view. FIG. 3A and FIG. 3B are different views of a package formed in the present disclosure. FIG. 3A is a perspective view, while FIG. 3B is a front view.

Referring first to the exemplary embodiment of FIG. 2A and FIG. 2B, again, each roll 102 is formed from a long strip of a polymeric substrate having a metal thin film coating on one side, the strip being rolled up. Two disc separators 104 may be used for each roll, one on each side of the roll 102. The disc separator should be compressible, but remain sealed. Instead of using polyethylene or polypropylene anti-static foam, the disc separators are made from a metalized polyester bubble wrap. This is a three-layer product having a layer of metalized polyester facing the roll 102, then a layer of bubble, and a backing sheet. It is noted that the diameter of the disc separator 104 is the same as, or less than, the diameter of the roll 102.

Next, instead of using a polyethylene stretch wrap, a polyester film is used instead for the covering material 112 of the roll. The polyester film is wrapped around the combination of the roll 102 and its two disc separators 104, i.e. the disc separators 104 are also within the polyester film 112. This seals the metal coating from the ambient environment. The polyester film can be clear/transparent, which allows for visual identification of the rolls. An example of a suitable polyester film is DuPont Melinex® 453. It has been found that a metalized polyester, an aluminum foil, or metalized polyethylene terephthalate (PET) can also be used as the covering material 112 for the roll.

Moving now to FIG. 3A and FIG. 3B, multiple rolls 102 can be placed together and then bound together by wrapping them again to form a bundle. If desired, a polyethylene stretch wrap can now be used. The covering material 112 separates the metal on the rolls from this second wrapping layer 114. This second layer also further reduces infiltration of contaminants, such as dust, into the rolls 102.

Next, examining FIG. 1, it can be seen that the cutout 110 of the board 101 exposes the side of the outer rolls to the environment. Referring back to FIG. 3B, a stiff spacer 120 is added to each end of the bundled rolls to both keep the outermost disc separators flat, and to cover up the space that is otherwise exposed by the cutout 110. The spacer 120 can be made from a stiff corrugated polypropylene.

The packaging materials and methods disclosed herein can be used to prevent degradation of surface energy and water contact angle for the metal films on polymeric substrates. This can be measured via change in water contact angle over exposure time.

The present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

First Set of Experiments

Various polymeric substances were investigated in order to determine the extent of their interaction with metal, specifically palladium. Materials were wrapped around a roll so that they were adjacent to the palladium. The wrapping was maintained for 24 hours, and the palladium surface was then tested for water contact angle (WCA).

Samples of 12 to 18 inches long were aligned and stacked so that the edges were parallel to one another and the samples in direct physical contact with one another. An additional sample was placed on top of the stack as a "cover sample." Samples were handled with gloves and when transported were secured so that the samples stayed in physical contact with one another.

4 drops (10 μL each) Triton X (0.1%) solution were placed across the web, one drop about 0.25 inches from the datum side, one drop about 0.25 inches from the smear side, and the other two drops roughly equally spaced in the center 1.5 inches of the samples. After 15 seconds, the samples were evaluated for wetting.

The sample was trimmed to remove the tested area before restacking and sending the samples for WCA measurement.

For WCA measurement, five drops were placed across the web, a first drop about 0.25 inches from the datum side, a second drop about 0.25 inches from the first drop, a third drop in the center of the sample, a fourth drop about 0.25 inches from the smear side, and a fifth drop about 0.25 inches from the fourth drop between the third and fourth drops.

Drops were visually evaluated and measured. A WCA measurement of less than 75 degrees indicated a pass, while a WCA measurement of 75 degrees or higher indicated a failure. If any drop measured 75 degrees or higher, the WCA was re-measured about 2 inches down web from the original test location. If a second measurement of 75 degrees or higher was obtained, the cut was put on hold, and a new sample was taken from the roll for testing and verification.

Measurements were completed within 4 to 6 hours of slitting, with a maximum time allowed of 24 hours.

The selection of packaging materials was influenced by the commercial availability of materials, which included polyester cover wrapped in polyethylene. Other materials tested included the matte side of aluminum foil, a polyester cover alone, the shiny side of aluminum foil, PET 453 (non-primer side), PET 453 (cover with PVC shrink wrap), polyurethane foam, air, polypropylene white foam, PVC shrink wrap, and pink anti-static foam.

Again, the WCA is a useful standard for characterizing the wettability of surfaces. Angles below 90 degrees (i.e. closer to zero) indicate hydrophilicity, and a lower value is more desirable, as is maintaining that low WCA over time, for the metal coatings/films described herein. Angles greater than 90 degrees are indicative of hydrophobicity.

Figure 4:
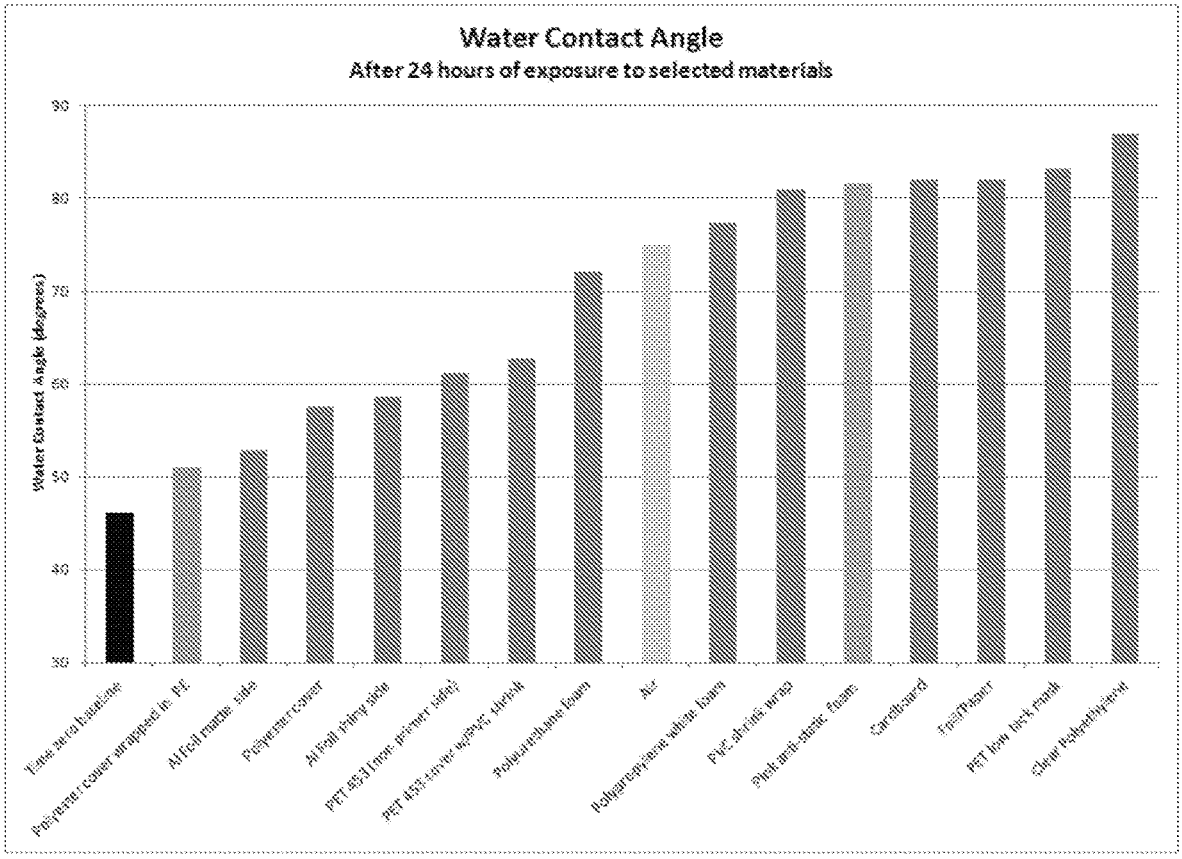
FIG. 4 is a graph showing the water contact angles of palladium films, measured after exposing the palladium film to different selected materials for 24 hours. A lower water contact angle indicates greater hydrophilicity, and is more desirable.

As shown in FIG. 4, the polyester substrates and those materials of a non-porous nature performed best; exhibiting water contact angle (degrees) of 65° or less, including 60° or less. Particularly, the polyester wrap showed the lowest water contact angle of about 51 degrees after 24 hours of exposure. The worst material combination included clear polyethylene, which had a water contact angle of nearly 90 degrees.

Second Set of Experiments

A side by side comparison was made between the standard pink foam packaging and the use of metalized polyester disc separators and polyester film wrapping, as it would be used for packaging eight separate 45-pound rolls. Bundles were wrapped in the two packaging configurations. After six weeks, samples were removed from the bundles and tested for WCA.

The metalized polyester bubble wrap exhibited overall lower WCA and increased hydrophilicity compared to the pink anti-static stretch wrap. In comparing the data from Table 2 to that of Table 1, it is clearly evidenced that the metalized polyester bubble wrap maintained a better water contact angle over time. All the reported values are the water contact angle, in degrees.

As shown in Table 1 and 2 below, datum and smear are references to the manner and orientation by which the rolls of film are slit. During shear slitting of rolls, the shear slitters displace material creating shear stresses. Particularly, a top blade penetrates the film, displacing it perpendicular to the remaining film and creating the smear edge. The datum edge is fully supported by the lower knife of the shear slitters and has no deflection or interaction.

In testing the water contact angle, five drops are placed across the film. Drops #1 and #2 are both placed within 0.5 inches of the datum edge, #3 is placed in the center of the film, and #4 and #5 are both placed within 0.5 inches of the smear edge. In both Table 1 and Table 2, #1 refers to the datum edge and #5 refers to the smear edge.

TABLE 1

| Pink anti-static finishing | | | | | | |
|---|---|---|---|---|---|---|
| Time in package | Cut | #1 | #2 | #3 | #4 | #5 |
| 6 weeks | A | 97.42 | 66.48 | 52.31 | 93.48* | 92.38 |
| 6 weeks | C | 45.26 | 74.24 | 37.18 | 75.5 | 89.27 |
| 6 weeks | F | 100.12 | 62.32 | 32.89 | 84.38 | 91.14 |
| 6 weeks | H | 100.99 | 85.32* | 43.22 | 67.07 | 86.13 |
| 6 weeks | L | 97.75 | 57.04 | 54.25 | 59.38 | 84.93 |
| 6 weeks | P | 93.27 | 56.03 | 45.5 | 80.89 | 92.63 |
| 6 weeks | S | 99.63 | 73.73 | 59.85 | 89.05* | 90.9 |
| 6 weeks | V | 98.76 | 90.54* | 43.17 | 65.66 | 83.16 |

*denotes the edge of the rolls packed at the outside ends of the bundle (i.e., roll faces are adjacent to boards 101)

TABLE 2

| Metalized polyester finishing | | | | | | |
|---|---|---|---|---|---|---|
| Time in package | Cut | #1 | #2 | #3 | #4 | #5 |
| 6 weeks | A | 65.66 | 57.81* | 49.14 | 56.29 | 60.99 |
| 6 weeks | B | 72.7 | 61.75 | 50.86 | 56.36 | 70.54 |
| 6 weeks | C | 54.46 | 47.22 | 46.08 | 45.62 | 45.42 |
| 6 weeks | D | 49.32 | 47.22 | 44.81 | 51.15* | 63.1 |

*denotes the edge of the rolls packed at the outside ends of the bundle (i.e., roll faces are adjacent to boards 101)

Third Set of Experiments

Figure 5:
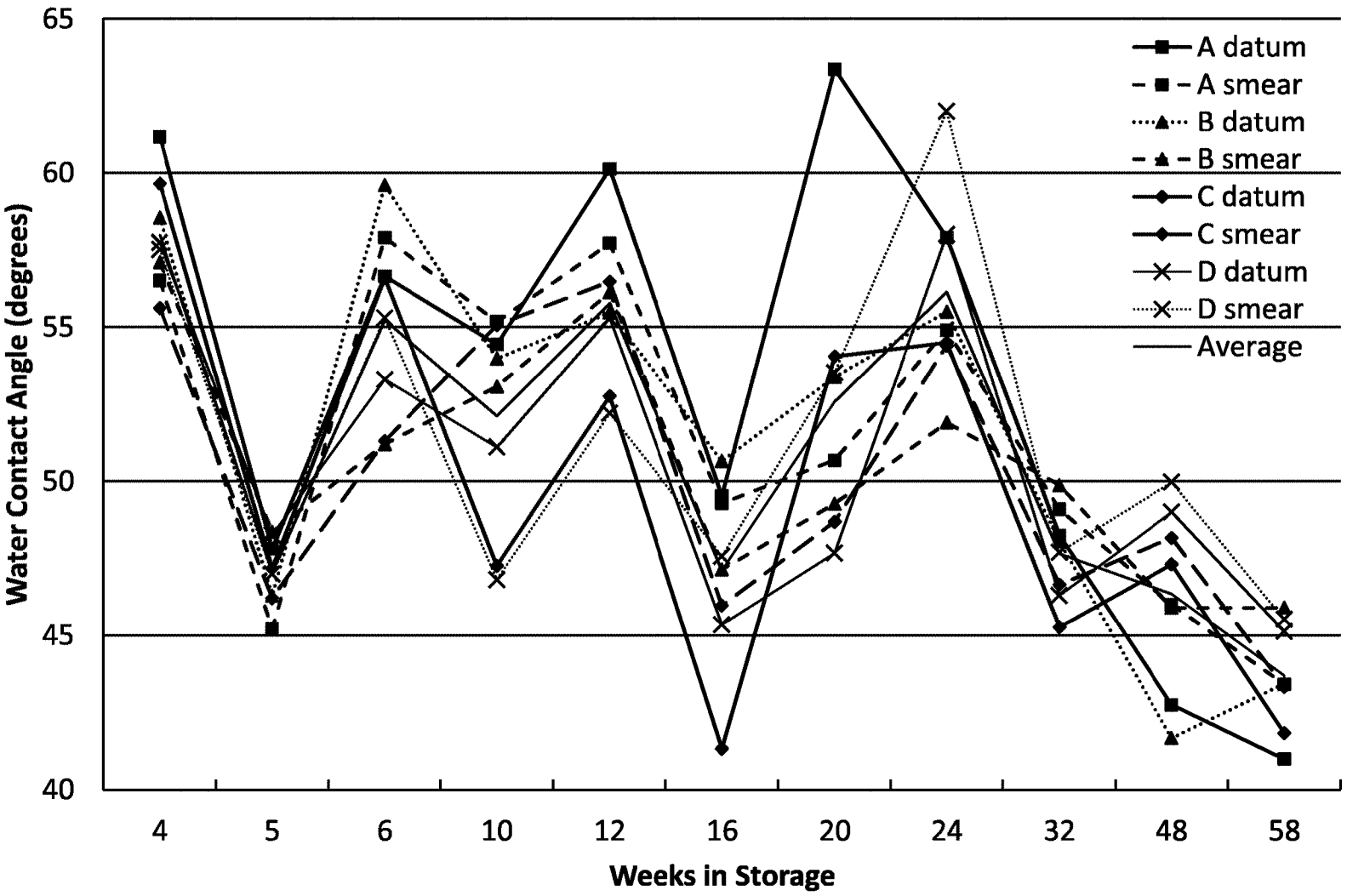
FIG. 5 is a graphic representation of regularly measured water contact angles of palladium films that have been stored for varying times up to 58 weeks.
Figure 6:
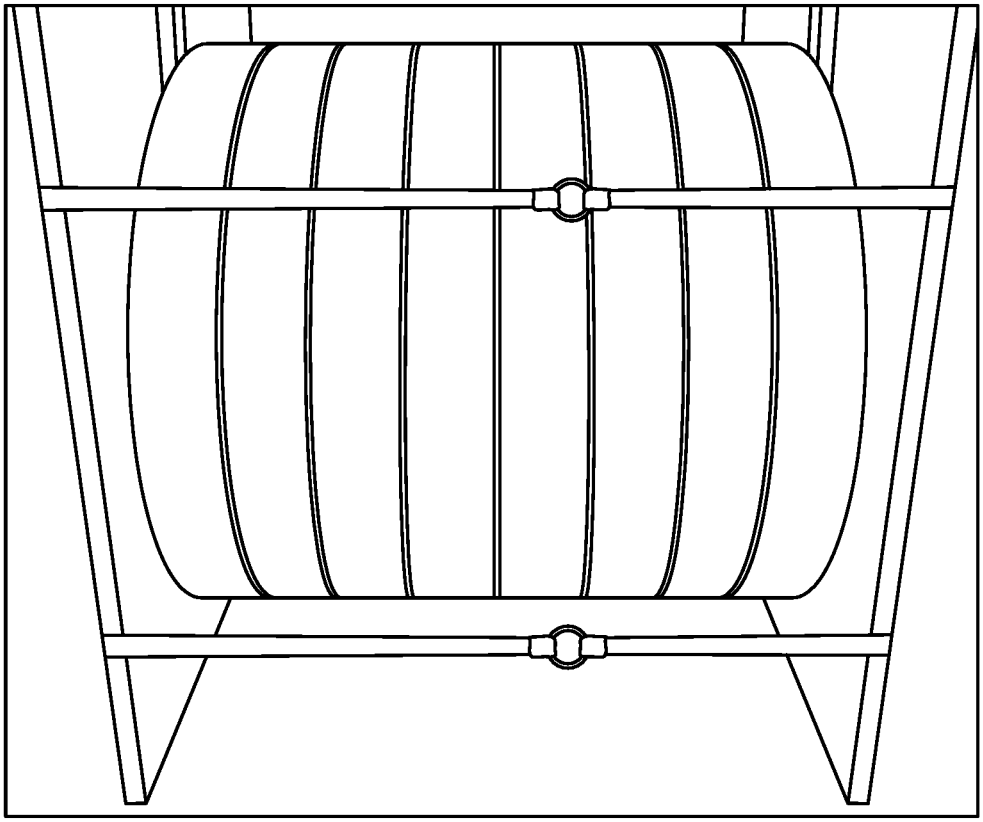
FIG. 6 is a front view of a package according to the methods of the present disclosure.
Figure 7:
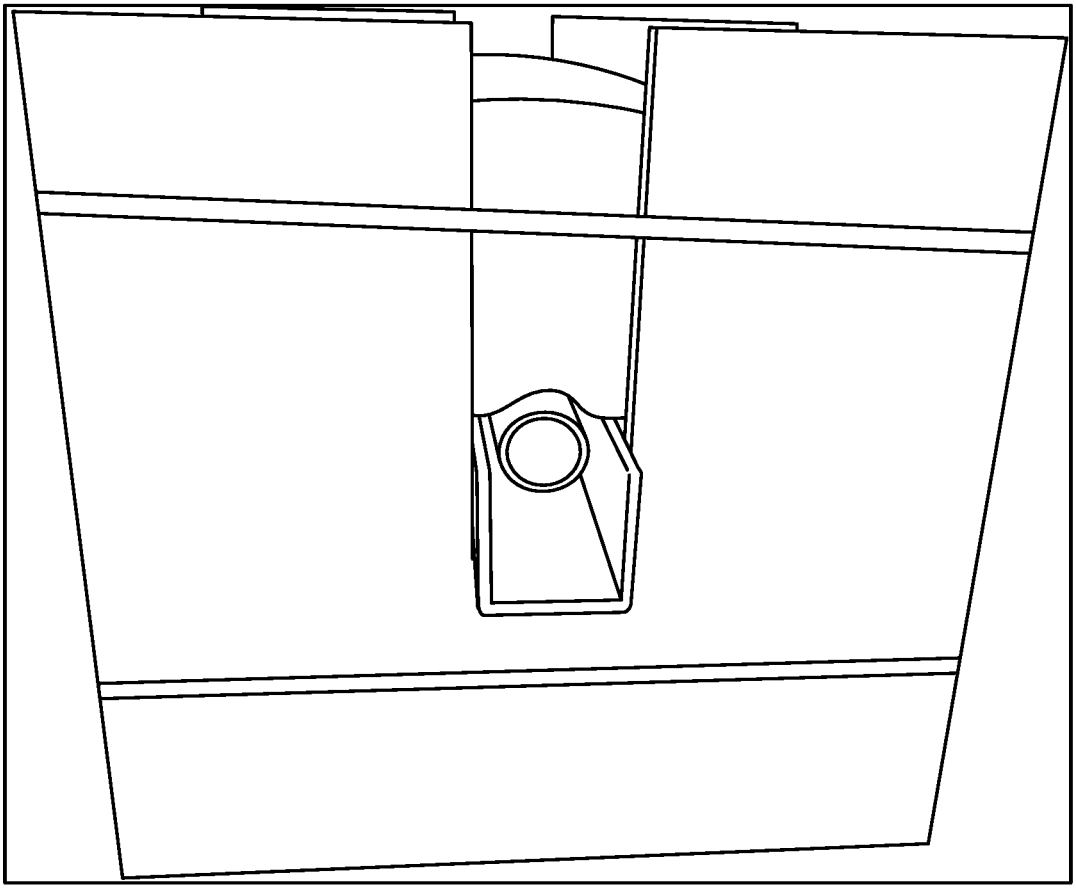
FIG. 7 is a side view of a package according to the methods of the present disclosure.

Testing of the present packaging using metalized polyester disc separators and polyester film wrapping was then carried out over 58 weeks. As shown in FIG. 5, there was no recognizable degradation of surface wettability. The data points (datum) and smear edges indicated the water contact angle remained between about 45 degrees and about 64 degrees over the entire 58-week period. FIG. 6 is a front view of the package, and FIG. 7 is a side view.

Discussion

The results of these experiments showed that methods of packaging using polyester film and/or metalized polyester film and metal wraps can greatly prevent the loss of wettability of metal films over time of exposure. These methods may be applied to shipping and protection of metal-coated products instead of polyethylene-based packaging schemes While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

The invention claimed is:

1. A method of packaging a metal-coated substrate to maintain hydrophilicity and surface energy of a metal coating of the metal-coated substrate at as deposited levels, the method comprising:

providing a metal-coated substrate in a form of a roll, wherein the roll consists of a polymeric substrate and a palladium metal coating directly applied to the substrate;

placing disc separators on opposite sides of the roll, wherein the disc separators have a metalized polyester surface contacting the roll; and wrapping the metal-coated substrate and the disc separators in a polyester film.

2. The method of claim 1, wherein a surface of the metal coating is hydrophilic in nature.

3. The method of claim 2, wherein the metal coating has a water contact angle of 55 degrees or less after being wrapped in the polyester film for no less than 24 hours.

4. The method of claim 1, wherein the metal coating shows no degradation of surface wettability after no less than 58 weeks; or wherein the metal coating shows no surface fouling after no less than 58 weeks; or wherein the metal coating shows no loss in surface energy after no less than 58 weeks.

5. The method of claim 1, wherein the metal coating is in a form of a thin film on the substrate.

6. The method of claim 5, wherein the thin film is formed through vacuum deposition.

7. The method of claim 1, further comprising wrapping the substrate again to form a second wrapping layer, using a different covering material.

8. A method of packaging metal-coated products, each of the metal-coated products comprising a metal coating, to maintain hydrophilicity and surface energy of the metal coating of the metal-coated products at as deposited levels, the method comprising:

providing metal-coated products each in a form of a roll, the roll consisting of a polymeric substrate and a palladium metal coating directly applied to the substrate;

placing disc separators on opposite sides of the roll, wherein the disc separators have a metalized polyester surface contacting the roll; and covering each of the metal-coated products and the disk separators in a covering material selected from a group consisting of a polyester, a metalized polyester, an aluminum foil, and metalized polyethylene terephthalate (PET).

9. The method of claim 8, wherein a surface of the metal coating is hydrophilic in nature.

10. The method of claim 9, wherein the metal coating has a water contact angle of 65 degrees or less after being wrapped in the covering material for no less than 24 hours.

11. The method of claim 8, wherein the metal coating shows no degradation of surface wettability after no less than 58 weeks; or wherein the metal coating shows no surface fouling after no less than 58 weeks; or wherein the metal coating shows no loss in surface energy after no less than 58 weeks.

12. The method of claim 8, wherein the metal coating is in a form of a thin film on each of the products.

13. The method of claim 12, wherein the thin film is formed through vacuum deposition.

14. A kit for packaging metal-coated products, the kit comprising:

a polyester film;

a plurality of disc separators having a metalized polyester surface and configured to separate a roll of a metal-coated substrate into a plurality of rolls, wherein each of the rolls consists of a polymeric substrate and a palladium metal coating directly applied to the substrate;

at least one spacer, wherein the at least one spacer is a stiff corrugated polypropylene;

a metal channel configured to support the plurality of rolls of the metal-coated substrate; and at least one board, wherein the at least one board includes a cutout through which the metal channel passes;

wherein the plurality of rolls and the plurality of disc separators are wrapped by the polyester film.

* * * * *